US005327848A

United States Patent [19]

Hannon, Jr.

[11] Patent Number: 5,327,848

[45] Date of Patent: Jul. 12, 1994

[54] METHOD AND APPARATUS FOR KEEPING SURFACES ORGANISM FREE

[76] Inventor: John L. Hannon, Jr., 82 Lamarck Dr., Amherst, N.Y. 14226

[21] Appl. No.: 569,144

[22] Filed: Mar. 25, 1991

[51] Int. Cl.[5] ..... B63B 59/00

[52] U.S. Cl. ..... 114/222; 440/88

[58] Field of Search ..... 114/222, 183; 440/88

[56] References Cited

U.S. PATENT DOCUMENTS 1,319,550 10/1919 Wilson ..... 114/222

2,682,852 7/1954 Ruffolo ..... 440/88

3,309,167 3/1967 Galler ..... 114/222

3,650,310 3/1972 Childress ..... 440/88

3,946,694 3/1976 Belsky ..... 440/88

4,074,651 2/1978 Arduser ..... 114/255

*Primary Examiner*—Jesus D. Sotelo

[57] ABSTRACT

Apparatus adapted to prevent or eliminate the attachment of marine organisms to surfaces of marine craft through the use of localized heating of the protected surfaces.

5 Claims, 3 Drawing Sheets

METHOD AND APPARATUS FOR KEEPING SURFACES ORGANISM FREE

BACKGROUND OF THE INVENTION

Intakes of various water related power plants such as hydroelectric and nuclear electric generating plants, water supply and treatment plants, inboard, outboard or inboard/outboard boat motors, water jet motors, jet ski equipment, submarines, etc. generally operate in large bodies of water such as rivers and lakes. These power plants typically circulate the contents of the body of water about which they are operating in throughout their power mechanisms or engine. Frequently, these bodies of water contain elements that are undesirable to optimum performance of the power plant. For example, the water may contain algae, barnacles and other marine growth. In particular, a very detrimental organism that is increasingly troublesome throughout the world, most recently found in the Great Lakes of the United States, but historically also found in the waters in Central and Eastern Europe, is the Dreissena polymorpha, commonly referred to as a zebra mussel. This fresh water invader and its implications is described in a Cornell University publication, Sea Grant Fact Sheet 11-1989 which is herein incorporated by reference. Copies are available from New York Sea Grant Extension Program, State University College, Brockport, N.Y. 14420.

The zebra mussel is a serious problem because it attaches itself to the interior wall of intake pipes of power plants, boat motors, etc. These intake pipes generally bring cool water from the river into the plants and motors for the purpose of cooling. In the case of boat motors, the water is circulated around the engine to cool it and then ejected back into the river through a separate discharge channel. Colonies of these bivalve mollusks gather in the intake pipes. In fact, they have been known to stack themselves 8" thick or more. Once they are attached, they restrict the flow through the intake pipes, seriously affecting the efficiency and cooling capacity of electric plants and boat motors. In addition, zebra mussel larvae travels up into the intake pump itself, further affecting the cooling capacity. Ultimately, this reduced cooling capacity results in engine failure.

The zebra mussel spreads extremely rapidly to uninfested waters by unknowing fishermen and recreational boaters. The mussels attach themselves to boat hulls and engines, and as the boats travel, the population spreads. Unfortunately, the mussel has no significant predators, so there is no natural population control. Alternately, to exterminate them with known methods would kill most every life form in a given body of water. Therefore, chemical extermination is not an attractive solution to the zebra mussel problem. One option is to introduce a chemical in the area of concern; pipe, intake, etc. and meter the flow. This is viable to protect equipment, but is detrimental to the environment if sufficient quantities are used.

As a minimum control measure, it is desirable to prevent significant population of the mussels attached to places where they can cause the damage described above. A further, more stringent control measure is to prevent the zebra mussels from attaching themselves to these places at all. Namely, anywhere that water is being taken from the river or lake for any reason, it is desirable to prevent mussels form attaching to the transporting hardware. For example, in the case of power plants, the large pipes drawing water from the lake should be kept mussel-free. In the case of boat motors, the cooling water intake should be kept mussel-free. Equivalent examples exist for many other instances where water is drawn from a body of water.

Traditionally, special paints have been used to control the growth of marine life, especially on boat hulls. Bottom anti-fouling paints typically contain heavy concentrations of tin or copper. These paints are relatively effective in controlling the growth of algae, etc. when they are newly applied. Eventually, the paint wears off, contaminating the water, and is of limited effectiveness. For this reason, the boat owner must reapply the paint yearly. One possible solution to the mussel problem would be to plate the interior of all pipes prior to manufacture of a boat motor. Eventually, however, the preventative coat would wear off and the mussels would attach themselves. Another solution would be to make the pipes from copper or tin. While this would last longer, it will still cause hazardous metals to be deposited into the water supply.

Another possible preventative measure would be to place a screen over the intake pipe. This would prevent organisms, including adult mussels, from entering the pipe and attaching to the interior wall. However, the larvae are very small and it would be very difficult to utilize a small enough mesh to exclude the larvae without subsequently affecting the flow rate. Therefore, this is also a very limited solution. Yet another solution is to utilize centrifugal separation, but the larvae density is very close to that of water, and would pass through.

SUMMARY OF THE INVENTION

The present invention is directed to an improved method and apparatus which takes a novel approach of ridding surfaces of certain water organisms, including zebra mussels. An important feature of the invention is the use of localized heating to prevent or eliminate the attachment of the organisms to surfaces in contact with infested waters. Utilizing the method and apparatus of the invention allows simple, efficient and economical elimination of unwanted organisms in any system that they may be found to be detrimental, including but not limited to water intakes in water treatment facilities, electric generating facilities, chemical process plants, boat motors, etc. as well as boat hulls, live wells in boats, docks, pilings and buoys.

In accordance with the invention, surfaces that come into contact with infested waters are heated, either continuously, intermittently or sporadically. The heat kills whatever living organisms that are attached without significantly impacting the function of the surface itself. Alternately, the surfaces may be continuously, intermittently or sporadically scraped to remove the organisms.

DETAILED DESCRIPTION OF THE INVENTION

Figure 1:
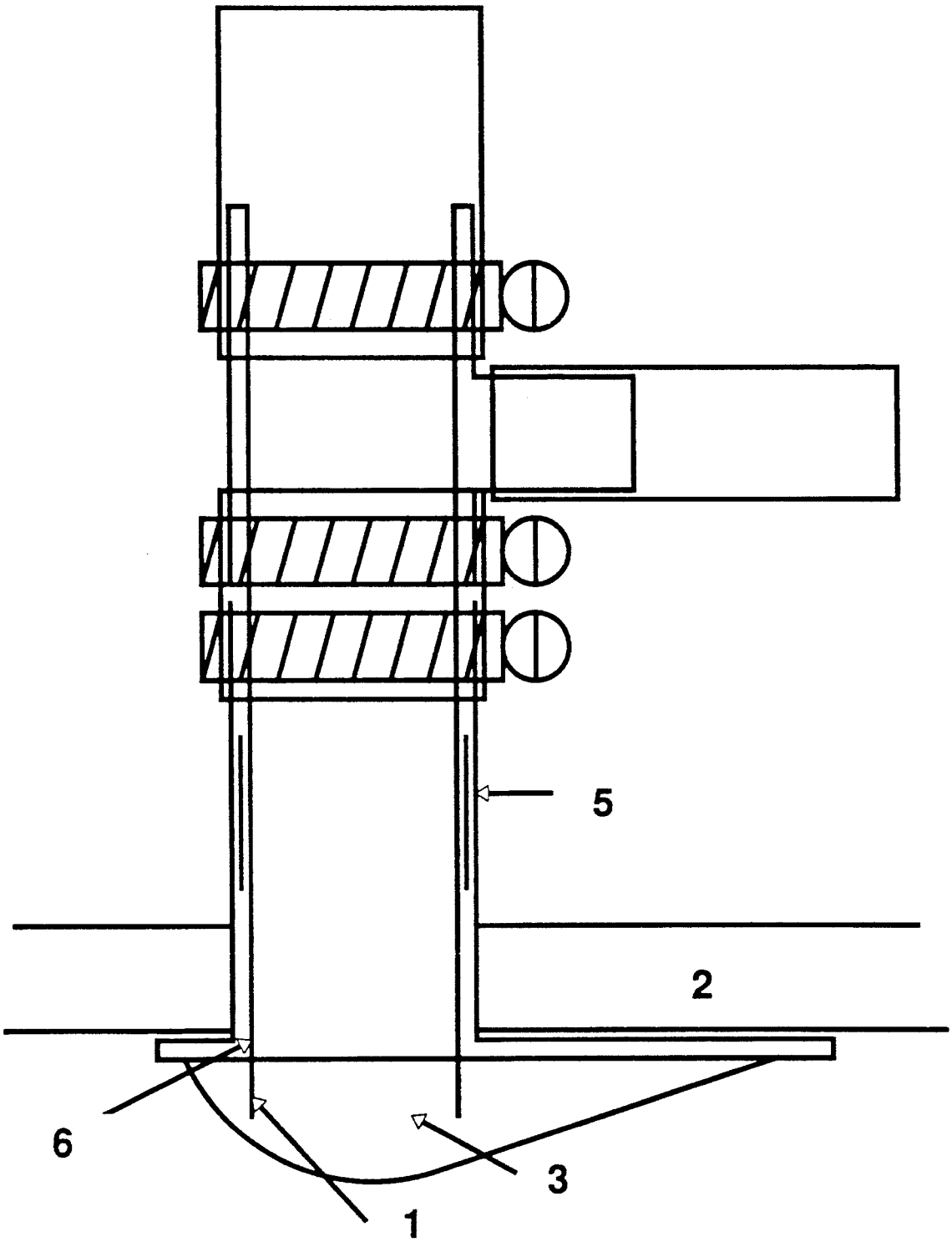
FIG. 1 shows the cross-section of a jacketed thru-hull water intake.

Most organisms living in water, including zebra mussels, thrive in cool temperatures, and are unable to withstand heat. Conditions generally considered unsuitable, particularly for zebra mussels, are waters outside the range of 45°-90° F. When exposed to elevated temperatures, particularly in excess of 104° F., the organisms die. Therefore, a very effective method of preventing attachment of marine organisms to surfaces is to elevate the surface temperature or the water temperature. It has been demonstrated that exposing zebra mussels to temperatures between 113° to 131° F. for a minimum of 10 minutes will quickly kill them. This varies with age and size of the mussel, with the larvae size, etc. More specific information on time at temperature required to kill the zebra mussel is available in the Sea Grant publication referenced above. In general though, the higher the temperature, the more quickly the mussel will be killed.

The heating could be accomplished any number of ways. One option is to provide auxiliary heaters to the hardware already present. For example, electric resistance heaters can be wrapped around pipes, pumps, buoys, water intakes, etc. to keep the surfaces at elevated temperatures. Power can be provided in any conventional manner, such as by battery or line voltage. The heaters could be run continuously at a moderate level, if desired. For example, in the case of intake pipes for a continuous operation, it may be desirable to continuously heat the pipes. If preferred, the heaters could be turned on intermittently. In the case of buoys, it may be desirable to provide the heating capability, but only visit and activate the heaters every three months or so. Or, in the case of a manufacturing facility, the heating could be in conjunction with some other maintenance schedule. Finally, the heating device may be activated sporadically. In the case of a boat, the heating elements could be present at all times, but powered only when the boat is docked. Any of the three options, continuous, periodic or sporadic can be effective. The key is to provide sufficient heat in excess of 90° F., and preferably in excess of 104° F., for a sufficient amount of time to kill the organisms present. If the periodic or sporadic options are used, it is recommended to kill the zebra mussels at least three times annually; in early summer, late summer and fall.

An alternate embodiment, especially useful in the cases where water is being drawn into a pipe for the purposes of cooling is to use a jacketed pipe. The cooling water flows through the center as in conventional systems. In addition, warm oil, water or exhaust air flows through the jacket section. This will maintain an elevated wall temperature and static boundary layer, discouraging the attachment of zebra mussels, without significantly affecting the temperature of the cooling water. The heating oil, water or air can be drawn from a number of places. This embodiment is especially attractive, because it provides the opportunity to utilize the heat that the cooling water absorbed while circulating past the hot item it was meant to cool, and be a recycling mechanism of sorts. In the case of boat motors, for example, the water is normally drawn into the intake pipe, circulated past the head, and discharged back into the body of lake or ocean. The water exhausted is typically 160°-200° F. As discussed above, this temperature range is more than sufficient to kill the mussels in a short time. Therefore, rather than simply deposit the water back into the lake or ocean, it is preferable to utilize the heat to kill or discourage attachment of zebra mussels. In the case of the motor, the water could simply be run through the jacket to heat the intake walls.

FIG. 1 depicts such a system. As is typically found in boats, an intake tube 1 projects beyond the bottom of the boat hull 2. The lake, river, bay or ocean water is pulled into this tube at the intake 3 and is pumped up to the engine. The water circulates around the engine (not shown) to keep the engine from overheating. As mentioned, as the cool water passes through and cools the hot engine, the water temperature itself is raised. The heated water is discharges through the jacket 5 and simultaneously heats the interior wall 6.

Figure 2:
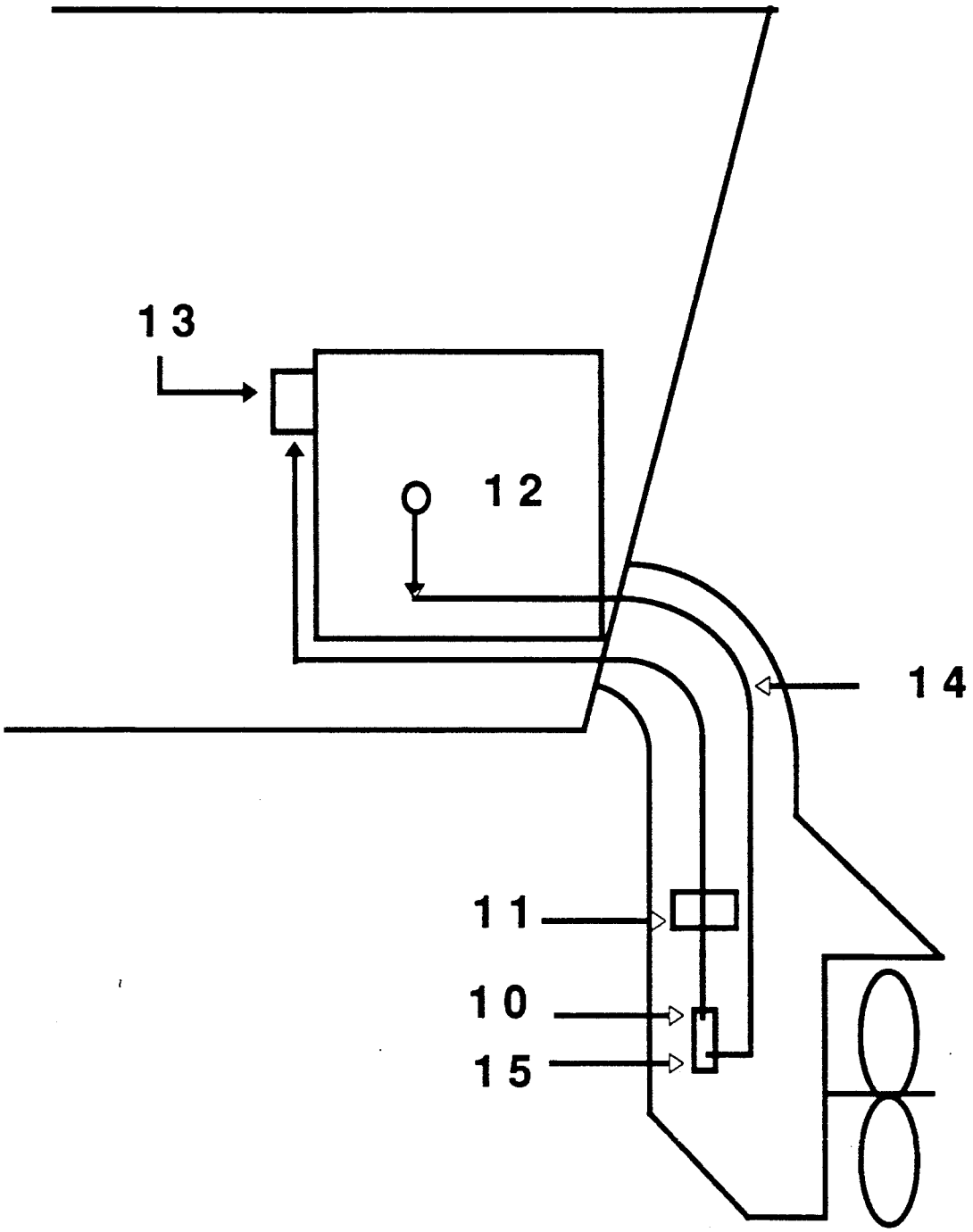
FIG. 2 shows an alternative arrangement of the invention as applied to a stern drive arrangement.

FIG. 2 depicts one possible implementation of this system for an inboard-outboard motor. The cooling water typically enters the motor through water inlet 10 and is delivered to the engine via water pump 11. The cold water supply enters the engine 12 and is circulated by additional water pump 13. A thermostat (not shown) is within the circulation loop. The thermostat is either open or closed depending upon the temperature of the engine. Typically in boat motors, if the temperature is below approximately 190° F., the thermostat is closed and the cooling water is not circulated around the engine and is simply discharged. If the temperature is above 190° F., the thermostat is open and the hot cooling water is discharged so fresh cool water can enter to cool the engine. In order to utilize the heat generated by the engine to heat the water inlet 10, a discharge hose 14 is inserted immediately preceding the thermostat in the circulation loop. The hose transports the heated water to the water inlet 15 and combines with the fresh water. The heated water heats the pipe, inlet and pump surfaces and thereby discourages the attachment of zebra mussels. When the thermostat is closed, most of the water, which will be somewhere between the temperature of the fresh water and 190° F. is diverted to the inlet 15. When the thermostat is open, the majority of the heated water is discharged through the normal exhaust, and only a portion is diverted to the inlet 15.

Figure 3:
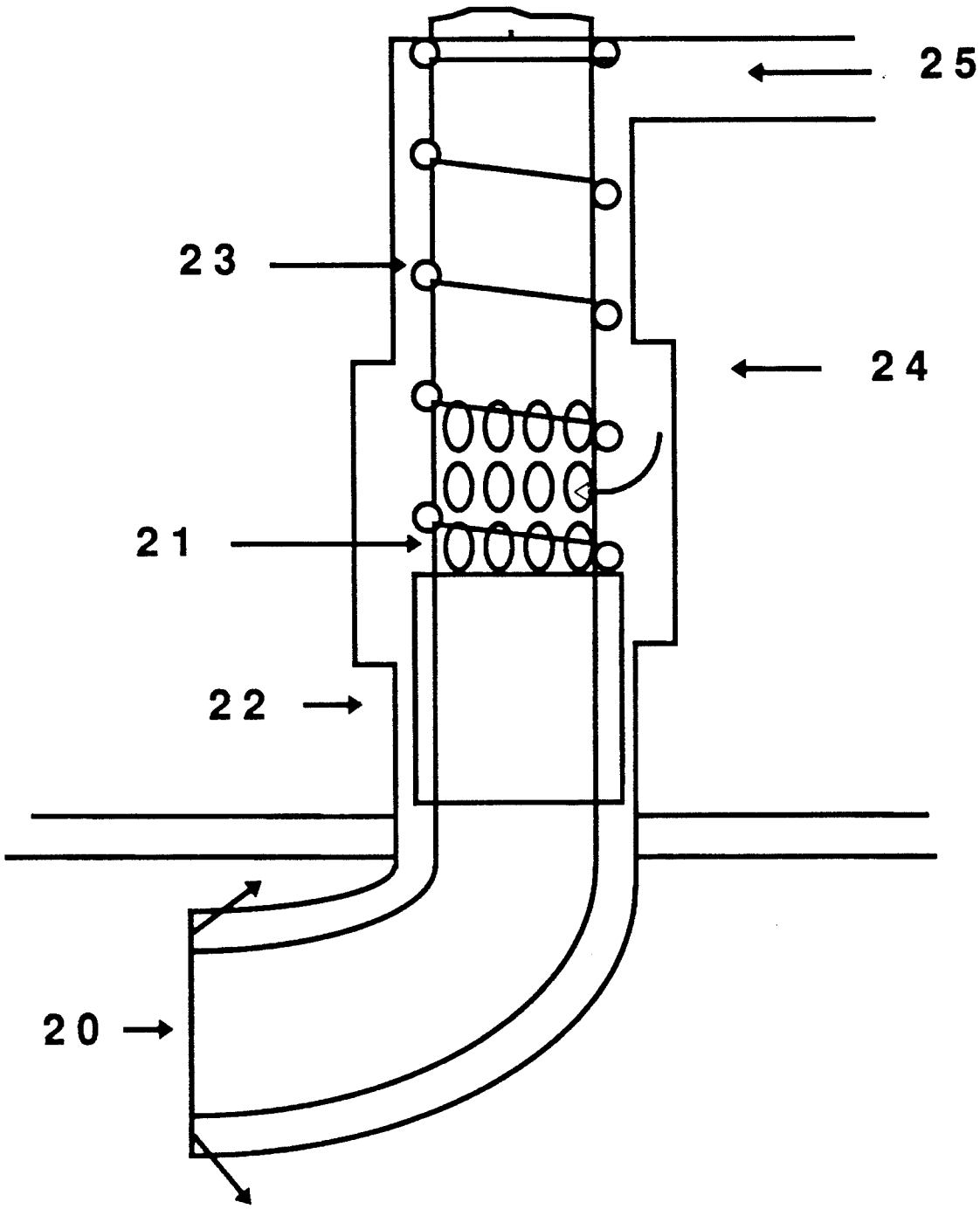
FIG. 3 shows an arrangement similar to FIG. 1 including a sliding thermostat.

A further refinement is depicted in FIG. 3. In this embodiment, the intake tube 20 contains a perforated section 21. A sliding valve tube 22 and an attached bimetal spring 23 are retained within the jacket 24. The recycle water enters the jacket at jacket inlet 25. The spring is chosen such that when the recycled water is below approximately 180° F. the spring is expanded and the sliding valve tube does not cover the perforations. FIG. 3 depicts the valve open position. The position of the sliding valve inhibits the flow out, and the recycle water goes through the perforations and combines with the fresh water. Allowing this relatively warm water to flow through the cooling loop will assure that any zebra mussel larvae that may be small enough to infiltrate the pumps, etc. are killed, and therefore do not grow and damage the engine. When the recycled water is above approximately 180° F., the bimetal spring contracts, and because the sliding valve tube is attached, it moves up, covering the perforations. The hot recycle water now bypasses the perforations and flows out through the jacket. The hot water flowing out heats the interior pipe surface, and thereby discourages attachment of zebra mussels.

Alternatively, periodically removing the marine growth mechanically would effectively control the detrimental effects. A power auger that scrapes the pipe wall would also minimize build-up. This could also be done continuously or intermittently depending on the operation. For instance, a water treatment plant may find it convenient to scrape intake walls when the plant is shut down for other routine maintenance such as filter replacement, etc. Alternately, an electric plant may desire to scrape continually, thereby avoiding any interruption of service. The exact conditions of scraping are dependent upon the application.

In addition to removing zebra mussels that are already present, or providing unattractive surfaces for them to attach to as the foregoing methods have emphasized, it is also possible to prevent the zebra mussels from entering an area at all. For instance, ultrasonic frequency waves could be directed across the mouth of an intake. By properly selecting the frequency, the mussels would be discouraged from populating the area. Alternatively, electric resistance or capacitance means (similar to that utilized in bug zapping mechanisms) could be positioned at an inlet, killing any mussels that ventured into the field.

I claim:

1. An apparatus for supplying power comprising;

a) an engine, b) a cooling system for the engine, wherein said cooling system includes a jacketed intake pipe, c) a circulation system for water through the engine, such that the water is heated by contact with the engine, d) means to recirculate the heated water through the jacketed cooling system and through the intake pipe.

2. The apparatus of claim 1 wherein the cooling system includes a thermostatically controlled bypass valve.

3. The apparatus of claim 2 wherein the bypass valve continuously allows heated water to pass through the circulation system.

4. The apparatus of claim 2 wherein the bypass valve periodically allows heated water to pass through the circulation system.

5. The apparatus of claim 3 wherein the heated water is allowed to pass through the circulation system at least once each time the apparatus starts up.

* * * * *